US012152489B2

(12) United States Patent
Kern

(10) Patent No.: US 12,152,489 B2
(45) **Date of Patent: *Nov. 26, 2024**

(54) MODULAR TUNNEL FORMWORK DEVICE

(71) Applicant: KERN Tunneltechnik SA, Paradiso (CH)

(72) Inventor: Reiner Kern, Paradiso (CH)

(73) Assignee: KERN TUNNELTECHNIK SA, Paradiso (CH)

( * ) Notice: Subject to any disclaimer, the term of this patent is extended or adjusted under 35 U.S.C. 154(b) by 58 days.

This patent is subject to a terminal disclaimer.

(21) Appl. No.: 18/062,199

(22) Filed: Dec. 6, 2022

(65) Prior Publication Data

US 2023/0220773 A1 Jul. 13, 2023

(30) Foreign Application Priority Data

Jan. 7, 2022 (EP) ..... 22150523
Jan. 20, 2022 (EP) ..... 22152345

(51) Int. Cl.
*E21D 11/40* (2006.01)
*E21D 11/10* (2006.01)

(52) U.S. Cl.
CPC ..... *E21D 11/102* (2013.01); *E21D 11/105* (2013.01); *E21D 11/40* (2013.01)

(58) Field of Classification Search
CPC ..... E21D 11/40; E21D 11/102; E21D 11/105
See application file for complete search history.

(56) References Cited

U.S. PATENT DOCUMENTS

2023/0220774 A1* 7/2023 Kern ..... E21D 11/105

FOREIGN PATENT DOCUMENTS

| | | |
|---|---|---|
| CN | 107130978 A | 9/2017 |
| CN | 107965337 A | 4/2018 |
| CN | 112780309 A | 5/2021 |

OTHER PUBLICATIONS

CN 112983481 (Year: 2021).*
EP 3168413 (Year: 2017).*
WO 99/53173 (Year: 1999).*
FR 2760041 (Year: 1998).*

* cited by examiner

*Primary Examiner* — Sunil Singh
(74) *Attorney, Agent, or Firm* — Welsh Flaxman & Gitler LLC

(57) ABSTRACT

A tunnel formwork device includes a frame and at least two support structures connectable to the frame of the tunnel formwork device and spaced apart from each other in the longitudinal direction of the tunnel formwork device for supporting the frame on a tunnel floor. The frame carries at least two hydraulic support cylinders at at least two positions spaced apart from one another in the longitudinal direction, which support cylinders can be connected to longitudinal beams running in the longitudinal direction. The longitudinal beams carry tunnel formwork elements of the tunnel formwork apparatus. At least one lifting device is arranged on the frame, which lifting device carries at least one working platform. The lifting device has a lifting drive for moving the working platform relative to the frame.

15 Claims, 7 Drawing Sheets

MODULAR TUNNEL FORMWORK DEVICE

BACKGROUND OF THE INVENTION

1. Field of the Invention

The invention relates to a modular tunnel formwork device for lining tunnel walls with concrete.

2. Description of the Related Art

The tunnel formwork is carried by a frame of the tunnel formwork device via hydraulic support cylinders. Checking the exact alignment and control of the support cylinders and checking the exact fit of the tunnel formwork is sometimes difficult due to the confined conditions in the tunnel.

SUMMARY OF THE INVENTION

It is therefore the task of the invention to create a tunnel formwork device that enables easier checking of its components and the formwork process.

This task is solved by a tunnel formwork device including a frame and at least two support structures connectable to the frame and spaced apart from one another in a longitudinal direction for supporting the frame on a tunnel floor. The frame carries at least two hydraulic support cylinders at at least two positions spaced apart from one another in the longitudinal direction. The support cylinders can be connected to longitudinal beams running in the longitudinal direction and longitudinal beams carry tunnel formwork elements. At least one lifting device is connected with the frame and carries at least one working platform. The lifting device has a lifting drive for moving the working platform relative to the frame.

Advantageous further embodiments of the invention are also disclosed in the description and in the figures.

The tunnel formwork device according to the invention includes a frame and at least two support structures, which can be connected to the frame and are spaced apart from one another in the longitudinal direction of the tunnel formwork device which is identical to the tunnel direction, for supporting the frame on a tunnel floor.

At at least two positions spaced apart from one another in the longitudinal direction, the frame carries at least two hydraulic support cylinders which can be connected to longitudinal beams running in the longitudinal direction, which in turn carry tunnel formwork elements of the tunnel formwork device. According to the invention, a lifting device is arranged on the frame, preferably at at least one end of the frame, which lifting device carries a working platform. The lifting device has a lifting drive, at least for height-adjustable displacement of the working platform relative to the frame, but preferably also for lateral displacement relative to the frame.

In this way, a possibility is created on the tunnel formwork device itself to check the correct setting of components, such as the hydraulic support cylinders, the correct position of the longitudinal beams and the tunnel formwork elements, and thus to qualitatively safeguard the formwork process. From the working platform, it is even possible to perform light work on the tunnel wall, e.g. for fixing components of the tunnel formwork equipment. If the working platform is arranged at the end of the frame, the entire working area of the tunnel formwork device can be reached more easily without the movement of the working platform being impaired by the frame of the tunnel formwork device and/or its components.

Preferably, the lifting device is also designed for horizontal travel of the working platform relative to the frame, at least perpendicular to the longitudinal axis. In this way, the working platform can travel over the entire effective area of the tunnel formwork device up to the tunnel walls and ceiling, in order to enable inspection and, if necessary, manual correction or repair of components of the tunnel formwork device, such as the support cylinders, the longitudinal beams, the tunnel formwork elements, or the connections of the concrete pumps.

Preferably, the at least one working platform is supported in a height-adjustable and/or laterally adjustable manner by means of the hydraulic lifting device at the two ends of the tunnel formwork device, and in the case of a modular structure of the frame of the tunnel formwork device, at its end modules. In this way, the correct formation of the tunnel formwork can be checked at all points. In addition, this at least one movable working platform helps with the positioning of the tunnel formwork elements and with maintenance or assembly work. Preferably, the lifting devices can be controlled via a common control arrangement of the tunnel formwork device or separately via controls of the working platforms.

Preferably, the lifting drive is designed as an electric or hydraulic drive, which operates reliably in the environment of a dirty construction site area in the tunnel and can apply high forces, so that several workers and tools can be transported via the working platform.

In an advantageous further development of the invention, the lifting device comprises two pivotally connected support arms. In this way, a large working area of the working platform is achieved over the entire tunnel cross-section, at least above the frame. When using two working platforms arranged side by side, the working range of a working platform preferably extends over at least half of the tunnel cross-section at least above the frame.

In this case, the support arms are preferably pivotably connected both to the frame and to the working platform, so as to ensure a wide working range with the working platform aligned exactly horizontally.

Preferably, the support arms are driven by hydraulic cylinders of the lifting drive so that they can swivel relative to the frame and to each other, which is less susceptible to contamination on the drive side and also provides the necessary forces for moving the working platform.

In an advantageous further development of the invention, at least one working platform is arranged at each longitudinal end of the frame, which has the advantage that the tunnel formwork can be inspected at both ends of the tunnel formwork device.

Preferably, two working platforms are arranged at at least one longitudinal end of the frame, preferably at both ends of the frame, each covering one half of the tunnel cross-section in its working or adjustment range. In this way, the working area of the working platform is not impaired by the frame as it extends laterally and upwardly away from the frame.

In this case, the two working platforms are preferably arranged symmetrically with respect to a central longitudinal axis of the frame, so that both can be of identical design, and the division of the working area of the working platforms in the transverse direction of the tunnel formwork device is clearly defined.

In an advantageous further development of the invention, the travel range of the working platform in the transverse direction of the frame includes the adjustment ranges of all support cylinders, at least on one side of the frame, and is thus able to cover the entire effective range of the tunnel formwork device.

Preferably, the supporting structures have feet with rollers designed to move the tunnel formwork device in its longitudinal direction. In this way, the tunnel formwork device can travel along the tunnel and the at least one working platform can be used to approach any point in the tunnel.

Preferably, the working platform projects beyond the supporting structures of the frame and/or the frame at the end face, which makes it possible to move the working platform along the entire cross-section of the tunnel, even at locations where the frame is arranged along the length of the tunnel formwork device.

In an advantageous further development of the invention, the support structures comprise height-adjustable support legs. Thus, the working platform can additionally be influenced in its working range by adjusting the height of the supporting legs.

Preferably, the tunnel formwork device has a control arrangement at least for the lifting drive of the lifting device, which is connected to an input device arranged on the working platform for controlling the lifting drive. In this way, the movement of the working platform can be easily controlled from the platform in terms of operation.

Preferably, the tunnel formwork device comprises at least two modules, preferably comprises at least three modules connected to each other in the longitudinal direction of the tunnel formwork device, which can be connected to each other to form the frame. By means of the at least two modules, preferably by means of at least three modules interconnected in the longitudinal direction of the tunnel formwork device, a tunnel formwork device is thus formed, the length of which is adjustable by the number of modules used. This has the advantage that the length of the tunnel formwork device can be individually adjusted as desired by the number of intermediate modules selected. It should be noted that the longitudinal direction of the tunnel formwork device coincides with the tunnel direction.

Optionally, it can also be provided that the width of each module can be varied, for example by adapter pieces or by a hydraulic adjusting mechanism, so that not only the length of the tunnel formwork device in the longitudinal direction of the tunnel, but also the width of the tunnel formwork device can be adjusted according to the width of the modules. The working width of the modules can also be varied simply by adjusting the support structures and the length-adjustable hydraulic support cylinders accordingly so that both narrow and wide tunnel shapes can be formed. The tunnel shape is thereby adjusted by a corresponding adjustment of the length of the support cylinders, which are preferably hydraulically telescopic. By appropriately varying the standing width of the support structures, which are preferably adjustable both in their spacing in the transverse direction and in their height, adapted stability can be achieved even for wide tunnels. Thus, the vertical support cylinders do not necessarily have to be adjustable in length, since the height adjustment of the tunnel formwork device can also be realized via the support structure.

Due to the fact that the entire tunnel formwork device is of modular design, it can be transported comparatively easily, i.e. by common transport vehicles, such as semitrailer trucks or semi-trailers of freight trains. For example, if the length of a module in the tunnel direction is between 1 m and 4 m and the width is between 3 m and 10 m, conventional semitrailer trucks can be used to transport the modules because the maximum width and length regulations for the transports are not exceeded.

Preferably, the modules comprise two end modules, which form the two ends of the tunnel formwork device in the longitudinal direction, and at least one intermediate module to be arranged between the end modules, which can be positively and/or non-positively connected to at least one of the two end modules. The end modules can thus be designed specifically for the load-bearing function, e.g. for fastening the support structures, while the intermediate modules are designed for supporting the tunnel formwork by the support cylinders and the longitudinal beams. This distributes the different necessary functions of the tunnel formwork device, such as load-bearing function and supporting function of the tunnel formwork, to different module types, which is more economical and efficient than if one module has to fulfill all these functions. By providing the support via the end modules a secure support of the tunnel formwork device can be achieved, even if it has quite a lot of intermediate modules, e.g. between 2 and 10.

Preferably, the support structure is height-adjustable and is formed in particular by hydraulically telescopic support legs. The tunnel formwork device can thus be adapted to different tunnel heights. Preferably, the distance between the support legs can also be adjusted transversely to the tunnel direction so that the support structure can be adapted to different tunnel widths. If the support structures are height-adjustable, the vertical support cylinders need not necessarily be designed as hydraulically length-adjustable support cylinders, since the height adjustment can then be implemented via the support structures. Height adjustability also has the advantage that the tunnel formwork device can enter the tunnel at a reduced height, i.e. lowered, so that the tunnel formwork does not collide with tunnel sections that are already shuttered.

Preferably, the support cylinders are connected to load sensors so that the load absorbed by each support cylinder can be monitored via a central control arrangement and, if necessary, pressure peaks can be reduced by controlling the support cylinders accordingly. Here, of course, each support cylinder is preferably provided with a load sensor. The pressure peaks are reduced by controlling the concreting speed.

Preferably, at least one of the at least two support cylinders is hinged to the frame or the frame part of a module so that the support points for the tunnel formwork elements can be adapted to the local conditions. Alternatively or additionally, the longitudinal beams can be connected to the support cylinders via a pivoting mechanism so that the longitudinal beams can optimally engage behind the tunnel formwork elements, even if the support by the support cylinders is not exactly vertical from below.

In an advantageous further development of the invention, the longitudinal beams have hydraulically actuated plungers, in particular at their ends, for support on the tunnel wall or the tunnel ceiling. This fixes the longitudinal beams absolutely immovably between the supporting structures of the frame of the tunnel device and the punches, which, hydraulically actuated, rest firmly against the tunnel walls or the tunnel ceiling. When the tunnel formwork elements are backfilled with concrete, there is therefore no spatial change in the position of the tunnel formwork elements because they are clamped absolutely rigidly and stationary.

Preferably, each support structure is formed by two support legs, which can be detachably connected to the frame, preferably to the outermost frame parts of the end modules or intermediate modules in the longitudinal direction. For example, only the end modules can have the fastening structures for the support structures or support legs, which on the one hand ensures that the support structures are arranged at the two ends of the tunnel formwork device, and thus securely support the tunnel formwork device arranged there between. As already explained, these legs are both height-adjustable and adjustable in their distance. On the other hand, this allows the intermediate modules to have only those structures that are required to support the tunnel formwork, that is, the hydraulic support cylinders.

In an advantageous further development of the invention, only the frame parts of the intermediate modules support the hydraulic support cylinders, and the frame parts of the end modules each carry at least one working platform and are connected with the support structures. The working platform projects beyond the support structures on the end face of the frame. Preferably each end module carries two working platforms which allows easy access to the working area along the whole tunnel ceiling.

To ensure a simple structure of the tunnel formwork device, each module, preferably each end and intermediate module, has integrated connections for pneumatics and/or hydraulics and/or electrics.

The hydraulic support cylinders are connected to the longitudinal beams via at least one bolt, in particular a conical bolt, so as to ensure that the hydraulic support cylinder and the longitudinal beams are firmly connected.

In an advantageous further development of the invention, the tunnel formwork device has a control module with a control arrangement for the tunnel formwork device, which is preferably connectable to the frame. The control module can be formed, for example, by a cabin of the tunnel formwork device or a control box in which the control arrangement is arranged. Thus, on the one hand it can be easily operated there and, on the other hand, it is protected there against the dirt and moisture in the tunnel. This control arrangement then has all the necessary interfaces for the hydraulics, electrics and pneumatics of all the modules and is able to receive the force measurement data from the load sensors of the support cylinders and to carry out the adjustment and actuation of the support cylinders centrally for the entire tunnel formwork device. The control arrangement is preferably also designed for controlling the lifting device of the working platform(s), in particular via an input device on the working platform or optionally also by mobile terminals.

The working platform(s) is/are preferably designed as a working platform with a railing, wherein the input device for controlling the lifting drive of the lifting device is preferably arranged in connection with the railing, e.g. on a stand connected thereto.

The invention also relates to a tunnel concreting device comprising a tunnel formwork device of the above type and at least one concrete pump controlled by the/a control arrangement for controlling the support cylinders of the tunnel concreting device, wherein at least one delivery line of the concrete pump is connected to the intermediate space between the tunnel formwork elements and the tunnel wall. The concrete pumps are preferably controllable in response to signals from load sensors arranged in connection with the support cylinders. Via this measure, a tunnel of fairly arbitrary cross-sectional shape and length can be efficiently formed, with the control of the concrete pumps dynamically taking into account the degree of backfilling of the space between the tunnel formwork and the tunnel wall.

The following terms are used interchangeably: Working platform—lifting platform; lifting device—supporting device; driving device of the lifting device—lifting drive;

It is appreciated that the above-described embodiments of the invention can be combined in any way.

BRIEF DESCRIPTION OF THE DRAWINGS

The invention is described schematically below in the accompanying drawings.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Figure 1:
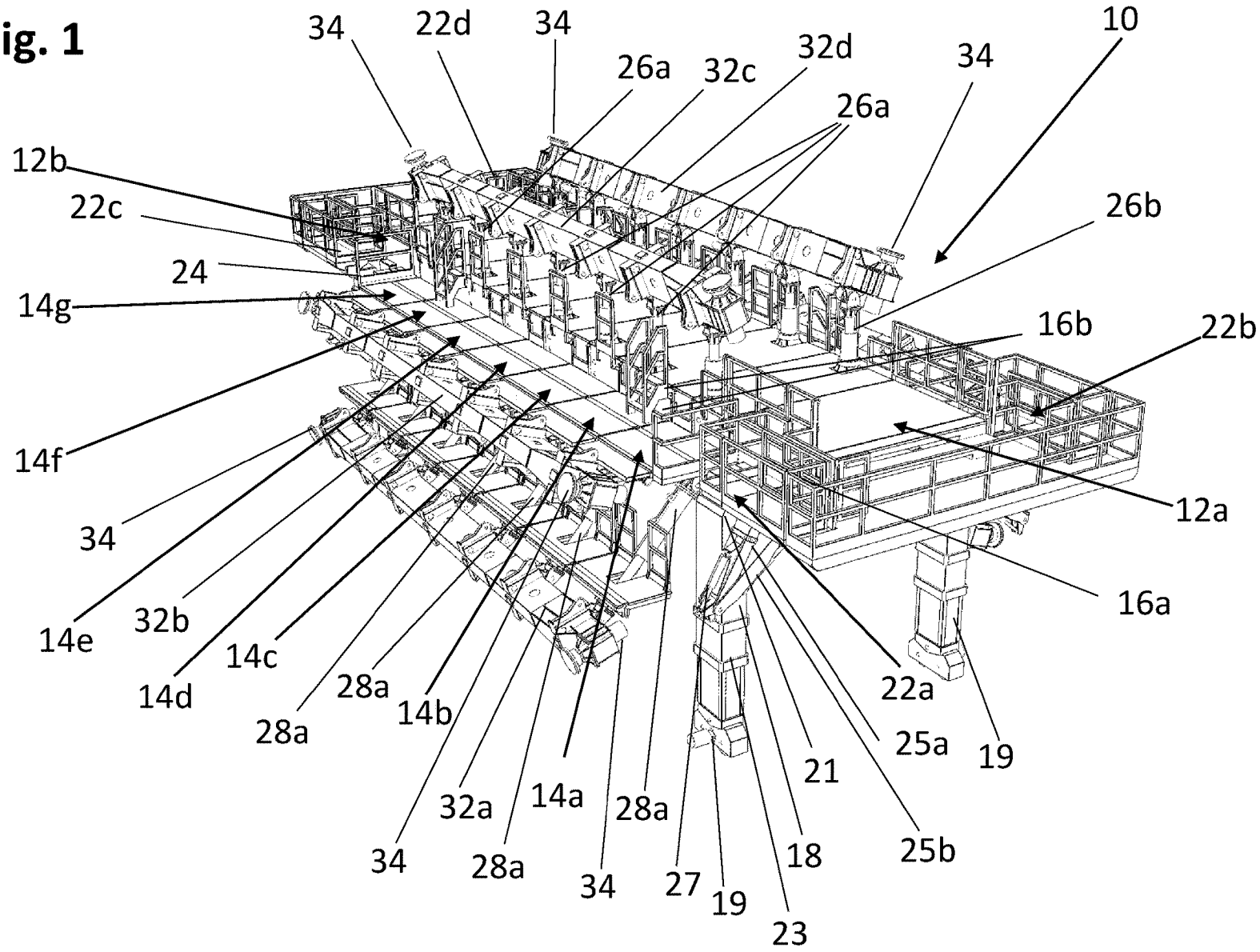
FIG. 1 is a perspective view of a tunnel formwork device composed of two end modules and seven intermediate modules.
Figure 2:
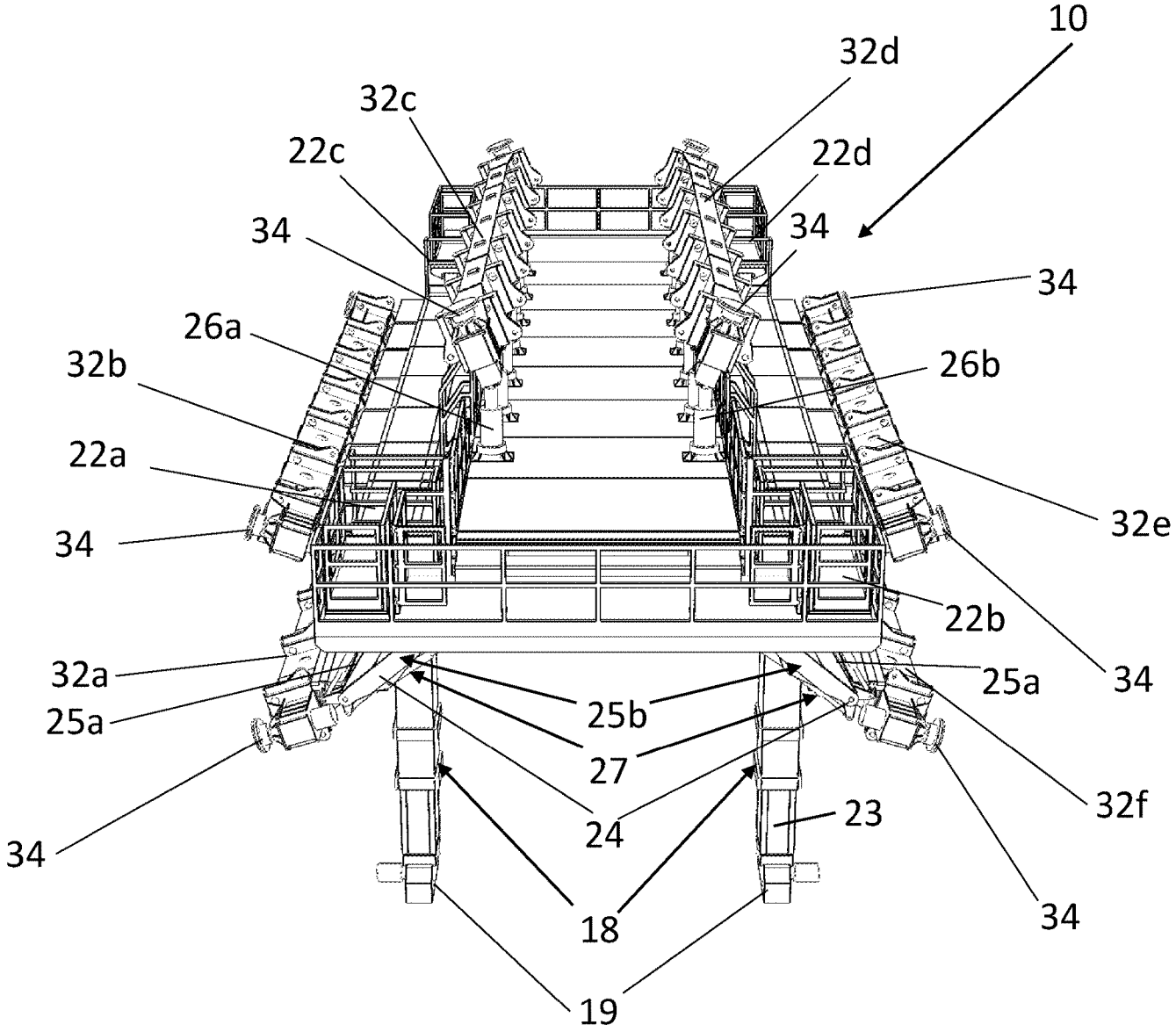
FIG. 2 is a perspective view in longitudinal direction of the tunnel formwork device.
Figure 3:
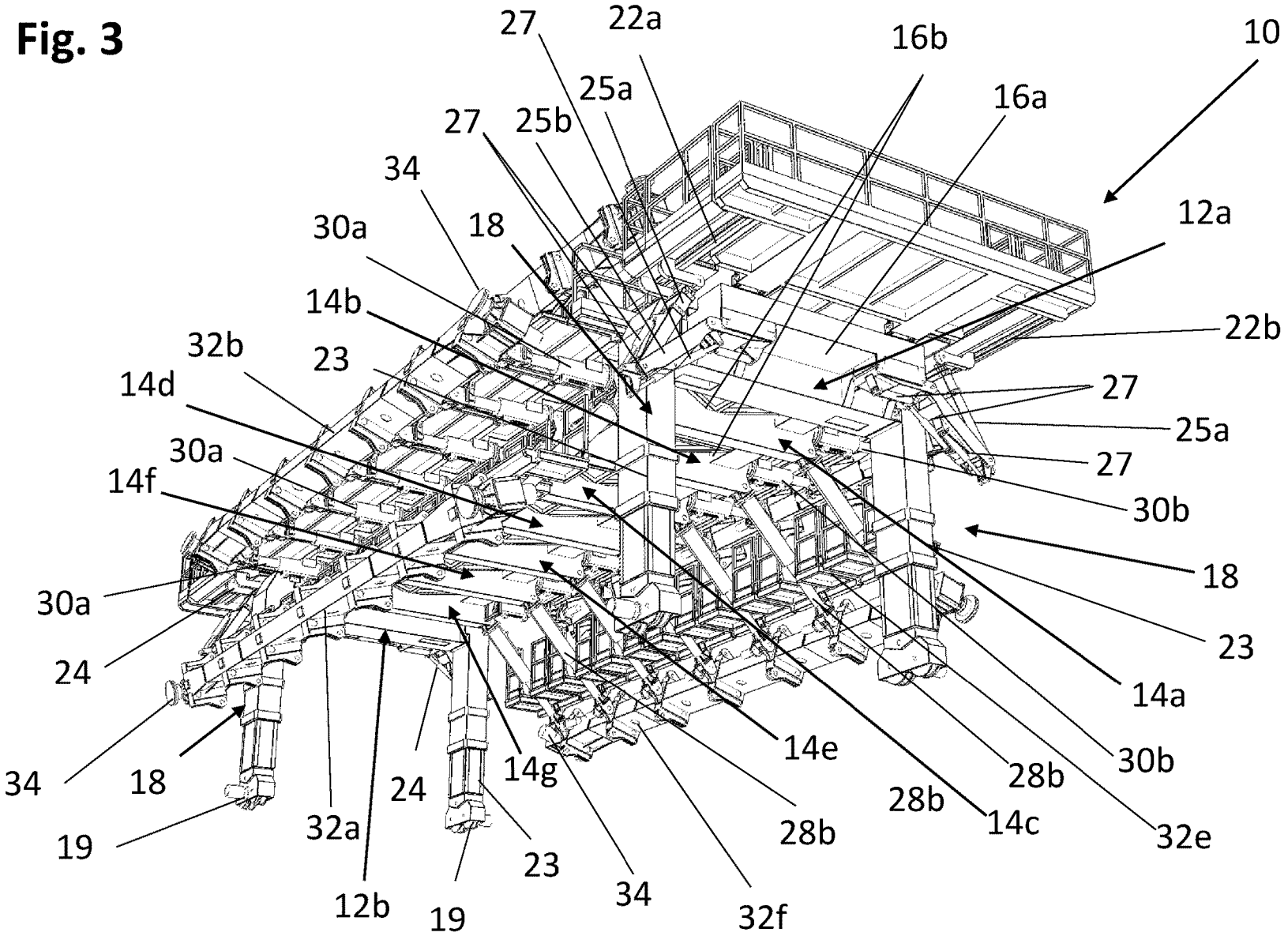
FIG. 3 is a perspective view of the tunnel formwork device of FIG. 1 from diagonally below.

In this embodiment, the tunnel formwork device 10 according to the invention has—not necessarily—a modular structure and is described below with reference to FIGS. 1 to 3. Accordingly, the modular tunnel framework device 10 comprises two end modules 12*a*, 12*b* and seven intermediate modules 14*a*-14*g* extending between the two end modules 12*a*, 12*b*, whereby adjacent modules are fixedly connected to one another. Each end module 12*a*, 12*b* includes a frame part 16*a* which is positively and/or non-positively connected to the frame part 16*b* of the adjacent intermediate module 14*a*, 14*g*, and also the frame parts 16*b* of the intermediate modules 14*a*-*g* are positively and/or non-positively connected to the adjacent intermediate modules 14*a*-*g* or end modules 12*a*, 12*b* preferably in the same manner to form a common frame 20 of the tunnel formwork device 10. The frame parts 16*a* of the end modules 12*a*, 12*b* are connected with supporting structures 18 embodied as two supporting legs each, which securely support the frame 20 of the entire tunnel formwork device 10, formed by the frame parts 16*a*, 16*b* of all modules 12*a*, 12*b*, 14*a*-*g*, on the tunnel floor. At the lower end of each support leg 18 is arranged a stand 19 with rollers, which can be moved along a path or rails in the longitudinal direction of the tunnel in the course of tunnel forming. The connection between the modules 12*a*, 12*b* and 14*a*-*g* or between their frame parts 16*a*, 16*b* is detachable so that the individual modules can be transported separately to the construction site. The support legs 18 are height-adjustable via a hydraulic telescopic mechanism 23, while their mutual spacing in the transverse direction (horizontally transverse to the tunnel direction) is adjustable via a horizontal telescopic mechanism 21 or by means of insertable adapter pieces.

Two movable working platforms 22*a*, 22*b* and 22*c*, 22*d* are connected via a hydraulic lifting device 24 to the frame 20. The lifting device 24 preferably comprises two pivotally interconnected support arms 25*a*, 25*b*, which are via a lifting drive 27 movable relative to one another. The lifting drive 27 comprises preferably a plurality of hydraulic cylinders to actuate the lifting device 24. Accordingly, the working platforms 22*a-d* can be moved horizontally, particularly laterally and can be raised and lowered relative to the respective frame part 16*a*, 16*b* and thus relative to the frame 20. Thus, inspections or assembly work on the tunnel formwork elements 33, on the hydraulically actuated rams 34 of the longitudinal beams 32*a-f* can be carried out via these working platforms 22*a-d*. At least one of the support arms 25*a*, 25*b* can optionally be adjustable in length, e.g. telescopic, in order to be able to increase the working range of the working platform 22*a-d* once again. In the present example, it is the first support arm 25*a* that is connected to the working platform 22*a-d*. The support cylinders 26, 28, 30 can be serviced from the hydraulically controlled working platforms.

The work platform or working platform 22*a-d* has a railing 29 to protect workers from falling. The lifting drive 27 comprising a plurality of hydraulic cylinders for moving the two support arms 25*a*, 25*b* relative to the frame 20. Via this measure the working platform 22*a-d* is movable over at least the associated half cross-section of the tunnel or working area of the tunnel formwork device 10, so that both working platforms 22*a*, 22*b* and 22*c*, 22*d* at one end of the frame 20 cover the whole tunnel ceiling to be lined.

The frame 20 extends at least approximately over the entire length of the tunnel formwork device 10. Two vertical hydraulic support cylinders 26*a*, 26*b* are preferably attached to the frame 20 for each intermediate module 14*a-g*, so that when the frame 20 is raised via the hydraulic telescopic mechanisms 23 of the support legs 18 for height adjustment, the vertical support cylinders 26*a*, 26*b* are also raised. Via this measure, tunnels of different heights can be lined and concreted with the tunnel formwork device 10. The vertical support cylinders 26*a*, 26*b* therefore do not even need to be hydraulic and adjustable in length.

The working platforms 22*a*, 22*b*, 22*c*, 22*d* are preferably controllable by control devices attached to the working platform 22*a*, 22*b*, 22*c*, 22*d* or its railing 29.

Each frame part 16*b* of the intermediate modules 14*a-g* carries in each case two obliquely downwardly pointing support cylinders 28*a*, 28*b* as well as two horizontally extending support cylinders 30*a*, 30*b* which, with respect to the tunnel center, extend symmetrically towards the tunnel sides facing away from each other. The free ends of the supporting cylinders 26*a*, 26*b*, 28*a*, 28*b*, 30*a*, 30*b* are each connected to longitudinal beams 32*a-f*, which in turn carry circular-arch tunnel formwork elements 33 (FIG. 4), which in their entirety form the tunnel formwork 37. The tunnel formwork device 10 thus controls six supporting cylinders or struts 26*a*, 26*b*, 28*a*, 28*b*, 30*a*, 30*b*, which extend over the entire inner circumference of the tunnel wall to be concreted, i.e. generally over a range of 150 to 270 degrees (see FIGS. 2 and 4). The tunnel formwork elements 33 may be supported on the tunnel floor 35 by separate support members 36. Alternatively, the supporting cylinders 28*a* and 28*f*, which point downward at an angle, may form the lowest support of the tunnel formwork 37 assembled by the totality of the tunnel formwork elements 33.

Figure 4:
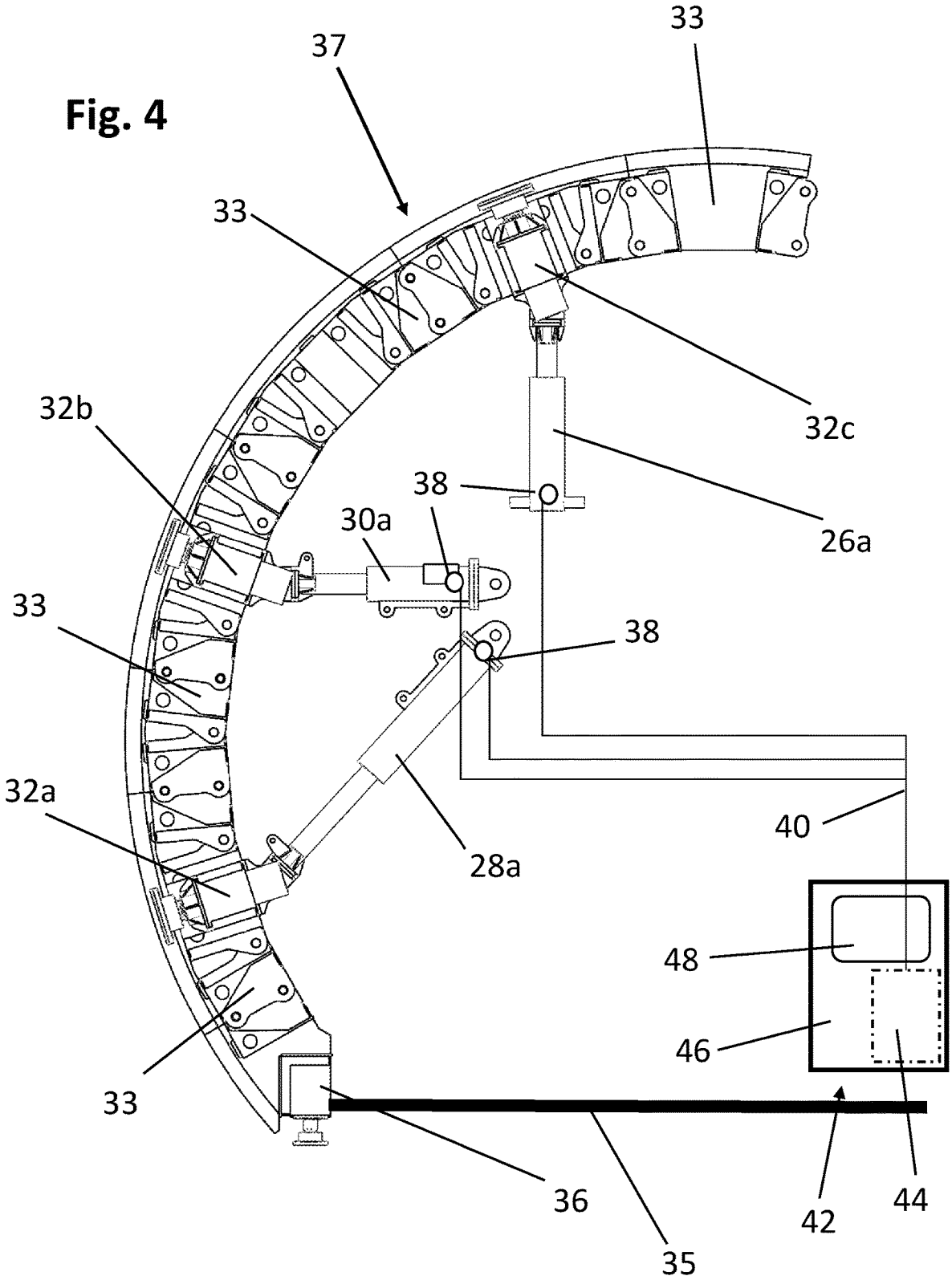
FIG. 4 is a side view of the tunnel formwork positioned by the support cylinders and the longitudinal beams towards the tunnel wall.

The support of the tunnel formwork 37 by the supporting cylinders 26*a*, 28*a*, 30*a* and by the longitudinal beams 32*a*, 32*b*, 32*c* is illustrated in FIG. 4. It is also evident from this illustration that the vertical support cylinders 26*a*, 26*b* do not have to be aligned exactly vertically, just as the horizontal support cylinders 30*a*, 30*b* do not have to be aligned exactly horizontally. These can be adjustable in their angle of attachment to the frame parts of the intermediate modules 14*a-g* at least in a small range of, for example, +/−15 degrees, while the support cylinders pointing downwards at an angle can preferably be adjustable in a larger angular range of, for example, 45 degrees. The support struts 26*a*, 26*b* are preferably rigidly, i.e. non-pivotably, attached to the frame 20 so that the tunnel formwork is fixed in its angular position, and the tunnel formwork 37 thus cannot tilt while the tunnel formwork device is in motion.

Needless to say, preferably all support cylinders 26*a*, 26*b*, 28*a*, 28*b*, 30*a*, 30*b* are provided with load sensors 38 which are connectable via data lines 40 to the central control arrangement 44 of a control module 42 of the tunnel formwork device 10. The control arrangement evaluates the data from the load sensors 38 and preferably also controls the support cylinders as a function of the recorded data in order to optimally position the tunnel formwork 37 and to actuate concrete pumps for filling the space between the tunnel wall and the tunnel formwork 37 in such a way that there is no excess load on the support cylinders or the tunnel formwork elements 33. On the tunnel formwork device 10, six longitudinal beams 32*a-f* are supported by seven hydraulic support cylinders 26*a*, 26*b*, 28*a*, 28*b*, 30*a*, 30*b*, respectively, which are connected to the seven individual intermediate modules 14*a-g*. In this way, the forces of the tunnel formwork 37 can be effectively absorbed by the tunnel formwork device 10, with the force transfer in the driving condition ultimately occurring through the support structures 18 into the tunnel floor 35. The two ends of each longitudinal beam 32*a-f* are provided with hydraulically actuated rams 34, which are controlled in such a way that they bear against the tunnel walls, whereby all longitudinal beams 32*a-f* are fixed in their position between these and the support structures 18, resulting in reproducible formwork results.

The control module 42 preferably includes a cabin 46, preferably with at least one window 48, in which the control arrangement 44 is positioned. In this way, it is effectively protected from the dirt and moisture of the construction site. The control module 42 may be positioned anywhere on the tunnel formwork device 10. Preferably, it is connectable to the support structure 18 or to a frame part 16*a*, 16*b* of an end or intermediate module 12*a*, 12*b*, 14*a-g*. The control arrangement is connected to hydraulics for actuating all support cylinders and to concrete pumps for filling the cavity between the tunnel wall and tunnel formwork 37 to optimally control the tunnel forming operation.

The working platforms 22*a-d*, which are movably held on the frame parts 12*a*, 12*b*, preferably protrude over the supporting structures or supporting legs 18 on the front side so that the ends of the tunnel formwork 37 and the entire tunnel formwork device 10 can be easily overlooked.

Figure 5:
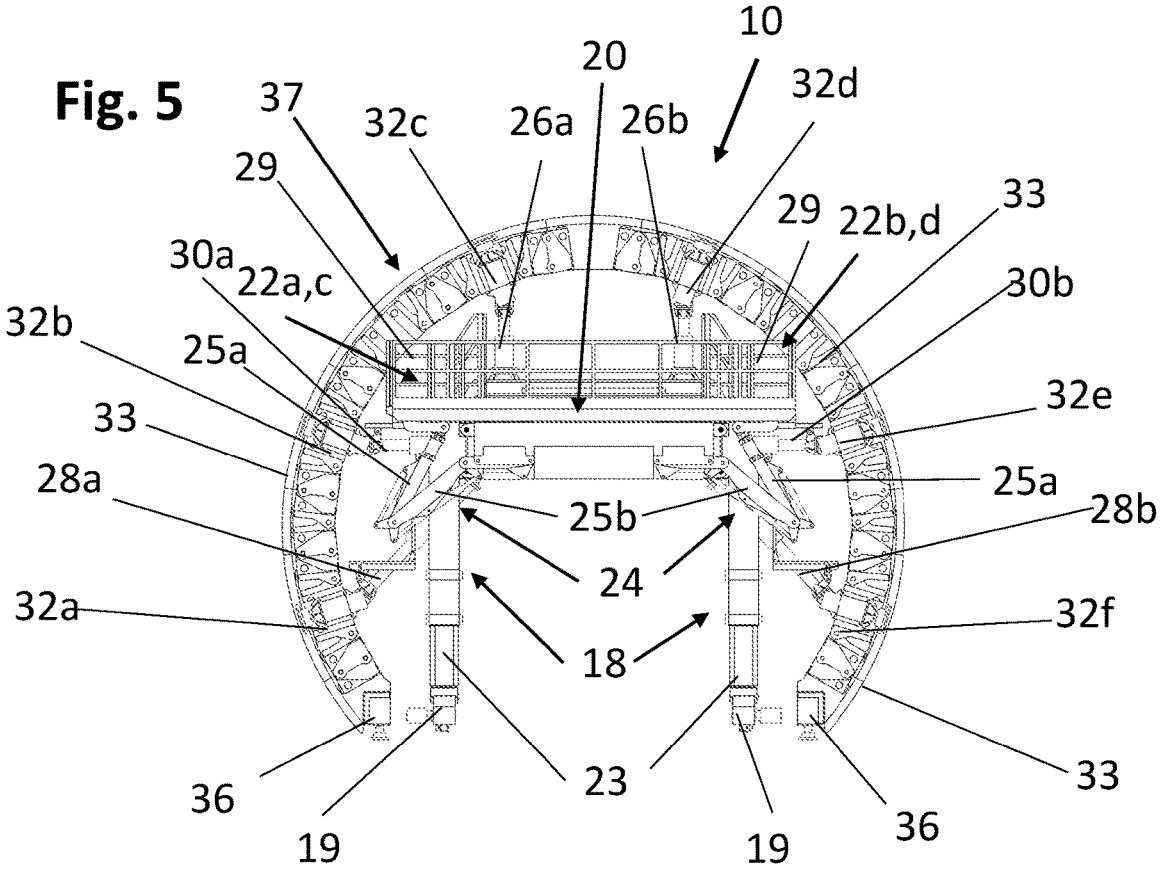
FIG. 5 is a frontal view of the tunnel formwork device from a longitudinal end.
Figure 6:
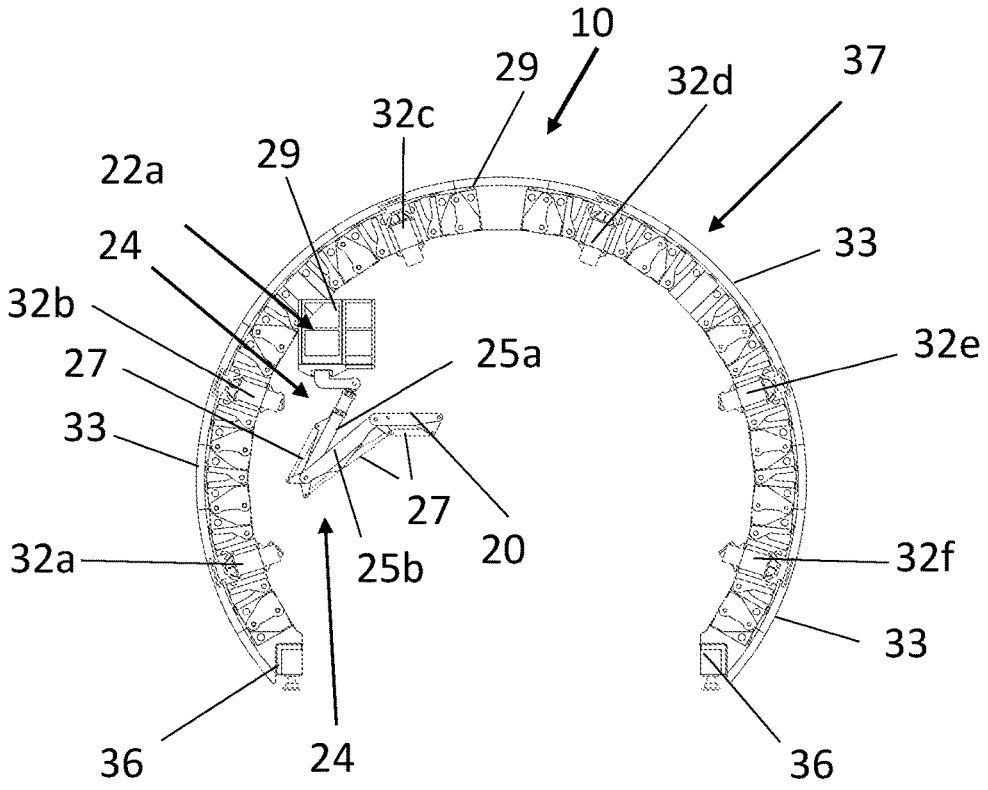
FIGS. 6-9 are frontal views showing the possible working areas of the working platforms.
Figure 7:
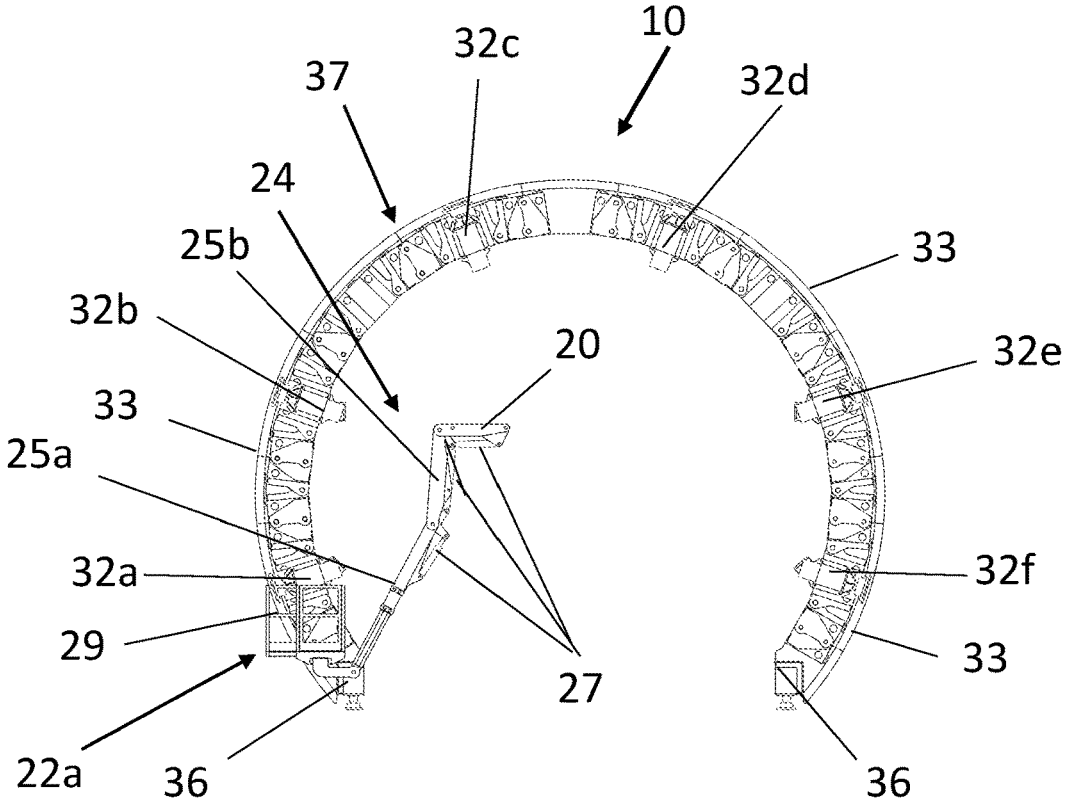
Figure 8:
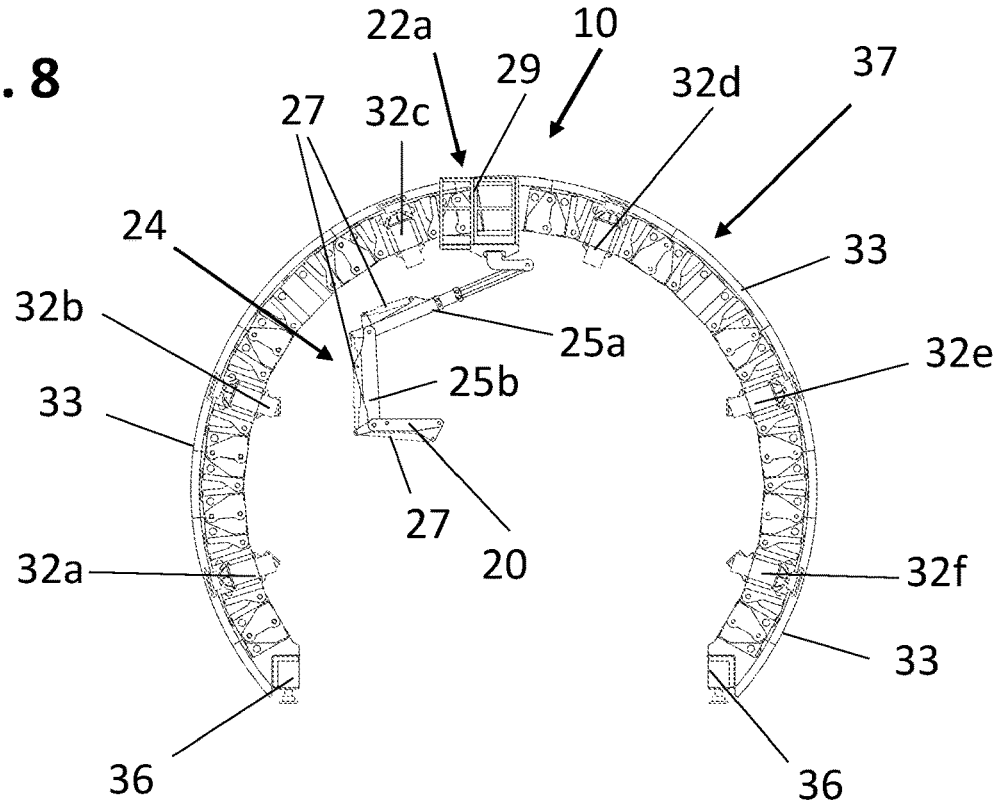
Figure 9:
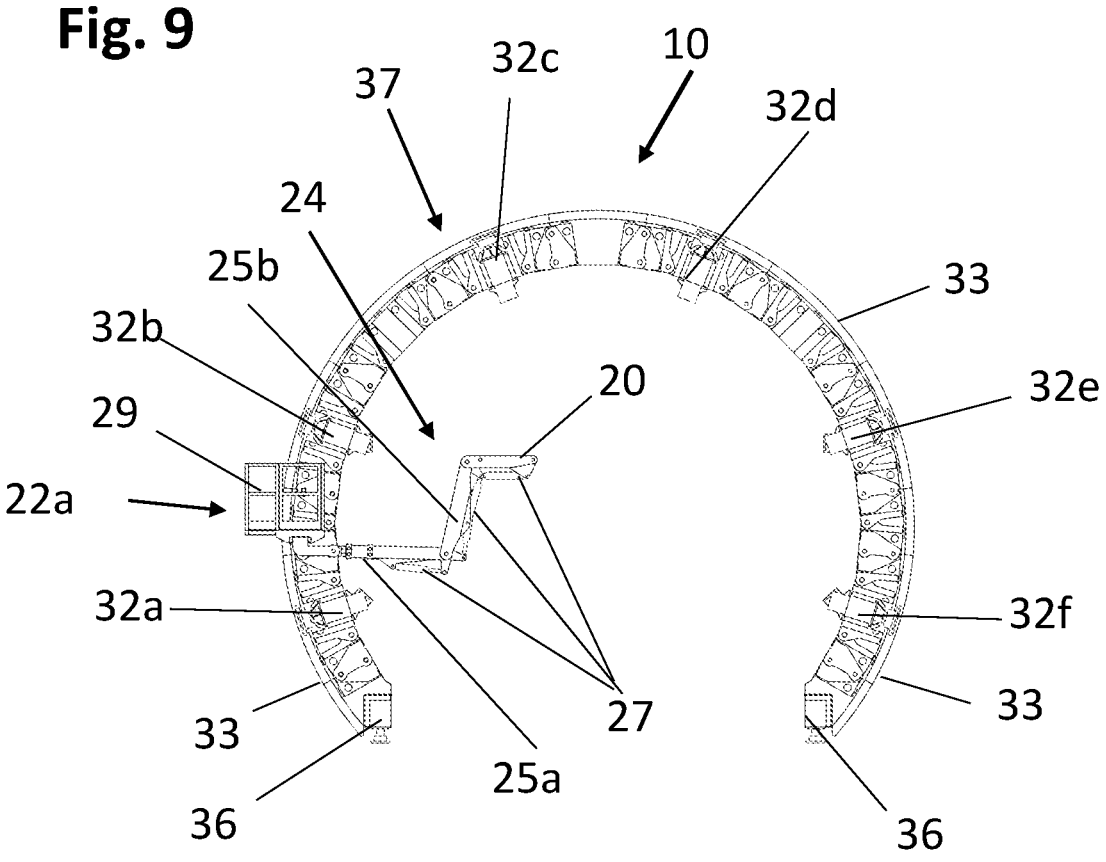

FIG. 5 shows the cross-section of the tunnel formwork device 10 shown in FIGS. 1 to 4 in more detail than FIG. 4. In all figures, identical or functionally identical parts are provided with the identical reference signs.

The complete tunnel formwork device 10 is shown in cross-section with the frame 20 supported on the supporting legs 18, with the supporting cylinders 26*a*, 26*b*, 28*a*, 28*b* and 30*a*, 30*b* arranged on the frame 20, the longitudinal beams 32*a-f* supported on the supporting cylinders 26*a*, 26*b*, 28*a*, 28*b* and 30*a*, 30*b* and extending in the longitudinal direction of the tunnel formwork device 10 (=tunnel direction), the tunnel formwork elements 33 stretched between them, which together form the tunnel formwork 37.

FIGS. 6 to 9 show different working positions of the working platform 22*a*, showing how comprehensively each of the four working platforms 22*a-d* at both ends of the tunnel formwork device covers a complete half of the tunnel cross-section or working area of the tunnel formwork device 10. The working platforms 22*a-d* can be moved under the frame 20, over the frame 20 and laterally away therefrom so that the entire corresponding tunnel formwork 37 can be inspected, as well as the corresponding components 26, 28, 30, 32, 33, 34 of the tunnel formwork device 10. At the components 26, 28, 30, 32, only visual inspections can be made from the working platforms be made, but rather no assembly or inspection work.

The present invention is not limited to the embodiment example, but may be varied as desired within the scope of the following claims.

LIST OF REFERENCE NUMBERS

10 tunnel formwork device
12*a,b* End modules
14*a-g* intermediate modules
16*a* Frame part of the end modules
16*b* Frame part of intermediate modules
18 Support structures—support legs
19 support legs with rollers
20 frame of the tunnel formwork device formed by the frame parts of the end and intermediate modules
21 horizontal hydraulic telescopic mechanism or adapter pieces for width adjustment, i.e. for adjusting the mutual distance of the support legs in the transverse direction
22*a-d* working platforms (lifting platforms) movable relative to the frame or frame parts of the end modules, two at each end module
23 vertical hydraulic telescopic mechanism for height adjustment of the supporting structure or supporting legs
24 hydraulic lifting device for the working platforms, in particular arranged on the frame parts of the end modules
25*a,b* two articulated support arms of the lifting device for vertical and lateral movement of the working platform relative to the frame, of which the first support arm connected to the working platform is adjustable in length
26*a,b* vertical support cylinders, in particular hydraulically or non-length-adjustable support struts, preferably fixed at a fixed angle to the frame
27 hydraulic lifting drive of the lifting device, comprising a plurality of hydraulic cylinders
28*a,b* support cylinders directed obliquely downwards, in particular hydraulically
29 railing of the working platform
30*a,b* horizontal support cylinders, in particular hydraulic
32*a-f* longitudinal beams running in the longitudinal direction of the tunnel formwork device for supporting the tunnel formwork elements
33 circular-arc tunnel formwork elements
34 hydraulically actuated rams on the longitudinal beams for supporting against the
35 tunnel wall—support rams
36 tunnel floor
36 floor support element
37 tunnel formwork
38 Load sensors
40 Data link
42 Control module
44 Control arrangement
46 Cabin
48 Window

The invention claimed is:

1. Tunnel formwork device comprising:

a frame, at least two support structures connectable to the frame and spaced apart from one another in a longitudinal direction for supporting the frame on a tunnel floor, the frame carrying at least two hydraulic support cylinders at at least two positions spaced apart from one another in the longitudinal direction, which the at least two hydraulic support cylinders can be connected to longitudinal beams running in the longitudinal direction, which longitudinal beams carry tunnel formwork elements, at least one lifting device is connected with the frame and carries at least one working platform, the at least one lifting device having a lifting drive for moving the at least one working platform relative to the frame.

2. Tunnel formwork device according to claim 1, wherein the at least one lifting device is also designed for horizontal and vertical movement of the at least one working platform relative to the frame.

3. Tunnel formwork device according to claim 1, wherein the at least one lifting drive is designed as an electric or hydraulic drive.

4. Tunnel formwork device according to claim 1, wherein the at least one lifting device comprises at least two pivotably interconnected supporting arms.

5. Tunnel formwork device according to claim 4, wherein the at least two pivotably interconnected support arms are pivotably connected both to the frame and to the at least one working platform.

6. Tunnel formwork device according to claim 4, wherein the at least two pivotably interconnected supporting arms are pivotably driven relative to the frame and to each other via the at least one lifting drive.

7. Tunnel formwork device according to claim 1, wherein the at least one working platform includes a working platform is arranged at least one longitudinal end of the frame.

8. Tunnel formwork device according to claim 1, wherein the at least one working platform includes two working platforms that are arranged at at least one longitudinal end of the frame.

9. Tunnel formwork device according to claim 8, wherein the at least one working platform includes two working platforms that are arranged symmetrically with respect to a central longitudinal axis of the frame.

10. Tunnel formwork device according to claim 1, wherein a travel range of the at least one working platform in a transverse direction of the frame comprises adjustment ranges of all supporting cylinders.

11. Tunnel formwork device according to claim 1, wherein the at least two supporting structures have supporting feet with rollers, which are designed for moving the tunnel formwork device in its longitudinal direction.

12. Tunnel formwork device according to claim 1, wherein the at least one working platform projects beyond the at least two supporting structures of the frame at an end face.

13. Tunnel formwork device according to claim 1, wherein the at least two supporting structures comprise height-adjustable supporting legs.

14. Tunnel formwork device according to claim 1, wherein it comprises at least two modules connected to each other in the longitudinal direction of the tunnel formwork device.

15. Tunnel formwork device according to claim 1, further including a control arrangement for the at least two hydraulic support cylinders.

* * * * *